US007214914B1

(12) United States Patent
Isaksson et al.

(10) Patent No.: US 7,214,914 B1
(45) Date of Patent: May 8, 2007

(54) METHOD OF OPERATING MICROWAVE OVEN AND DETERMINING THE COOKING TIME

(75) Inventors: Andreas Isaksson, Norrkoping (SE); David Wahlander, Norrkoping (SE); Fredrik Hallgren, Kolmarden (SE); Per Torngren, Norrkoping (SE)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 11/446,935

(22) Filed: Jun. 5, 2006

(51) Int. Cl.
*H05B 6/68* (2006.01)
*H05B 6/78* (2006.01)
*F24C 7/00* (2006.01)

(52) U.S. Cl. ..... 219/710; 219/720; 219/754; 99/451; 426/88; 374/149

(58) Field of Classification Search ..... 219/710–714, 219/752–754, 720, 506; 99/325, 451; 426/88; 116/216; 374/149, 150
See application file for complete search history.

(56) References Cited

U.S. PATENT DOCUMENTS 5,036,172 A * 7/1991 Kokkeler et al. ..... 219/710

FOREIGN PATENT DOCUMENTS

| | | |
|---|---|---|
| EP | 0272089 | 6/1988 |
| GB | 2312954 | 12/1997 |
| SE | 0302030 | 5/2004 |
| WO | 2005/004543 | 1/2005 |

* cited by examiner

*Primary Examiner*—Philip H. Leung
(74) *Attorney, Agent, or Firm*—Robert O. Rice; Stephen Krefman; John F. Colligan

(57) ABSTRACT

A method of operating a microwave oven to determine the correct cooking time for a food item placed within the oven. A food package having a thermochromic element which changes color over a predetermined temperature range is placed in the microwave oven. Microwave energy is supplied into the oven. The food package is rotated within the oven cavity and the color of the thermochromic element is monitored as it rotates past an opto-electronic device or detector capable of detecting the color changes of the thermochromic element such that a plurality of signal pulses are generated having a value corresponding to the color of the element. The supply of microwave energy into the oven is terminated when the rate of change between successive pulses decrease to a predetermined value.

10 Claims, 3 Drawing Sheets

METHOD OF OPERATING MICROWAVE OVEN AND DETERMINING THE COOKING TIME

BACKGROUND OF THE INVENTION

1. Field of the Invention

The present invention relates to a system for controlling the operation of a microwave oven and determining the cooking time for a food item, and more particularly to a system for monitoring the change in color of a thermochromic element associated with a microwave food package.

2. Description of the Related Art

Owners of microwave ovens often find it difficult to assess whether food is properly cooked. It is hard to know whether the inside of food is hot enough—or overcooked—even when correctly using guidelines on timing. Because the air inside a microwave oven does not heat up significantly compared to the food or packaging being heated, it is difficult to measure temperature of food within a microwave oven. The appearance of the food alone does not help to tell whether the inside of food is cooked or heated adequately because of the penetrative way in which the microwaves cook the food.

Many microwavable foods are purchased and supplied in packaging which can be directly placed inside a microwave and heated. In heating such packaged food items, it is likewise difficult to assess when the food is properly heated. In such a case, direct observation of the food is difficult or impossible to do and it is necessary to rely on guidelines for timing supplied with such food item. However, due to variations in a number of factors, such instructions are not always appropriate for proper heating. It is frequently the practice that heating or cooking of such food items is stopped and the oven door is opened so that the temperature of the food item may be tested, for example, by stirring or prodding the food item sometimes directly by finger. This is inconvenient and slows the cooking process, which can lead to a deterioration in the taste or texture of heated foods.

Various systems for directly sensing the temperature of food items heated in a microwave have been proposed. Published UK Patent Application GB 2 312 954 discloses a system of monitoring the temperature of a microwave container for heating food where the container is provided with a thermochromic composition which changes color over a desired temperature range and the color of the composition is monitored, visually or spectroscopically, during the heating process. In this way, it is possible to detect when the package or container has received sufficient microwave energy.

Swedish Patent SE 0302030 pertains to a device which provides temperature controlled heating of primarily solid food stuff in a microwave oven by monitoring the color changes in a heat sensitive, readable color (thermochromic) marking provided on a food stuff micro-wavable package. Since the temperature of the surface of the food stuff container during heating is not the same as the actual temperature of the food stuff, the color marking is located on the surface of a block of a polymer material, which is thermally insulated from the food stuff, and which is arranged to be subject to the same microwave radiation as the food stuff inside the oven, and which, through the choice of suitable dielectric properties, is subject to heating corresponding to that of the food stuff. The color change may be monitored by a detector.

While the prior proposed systems provide a partial solution to the problem of temperature measurement within a microwave oven, they do not address the practical realities of operating within a modern microwave oven. There is a need for a system which monitors the temperature of a food items being heated on a rotating microwave turn table.

SUMMARY OF THE INVENTION

One embodiment of the invention is a method of operating a microwave oven and determining the correct cooking time for a food item placed within the oven. In this embodiment, a food package having a thermochromic element which change color over a predetermined temperature range is placed in the microwave oven. Microwave energy is supplied into the oven. The food package (28) is rotated within the oven cavity and the color of the thermochromic element is monitored as it rotates past an opto-electronic device or detector capable of detecting the color change of the thermochromic element such that a plurality of signal pulses are generated having a value corresponding to the color of the element. The supply of microwave energy into the oven is terminated when the rate of change between successive pulses decreases to a predetermined value.

BRIEF DESCRIPTION OF THE DRAWINGS

The present invention will be more apparent from the accompanying drawings, which are provided by way of non-limiting example and in which.

DETAILED DESCRIPTION OF THE PREFERRED EMBODIMENTS

Figure 1:
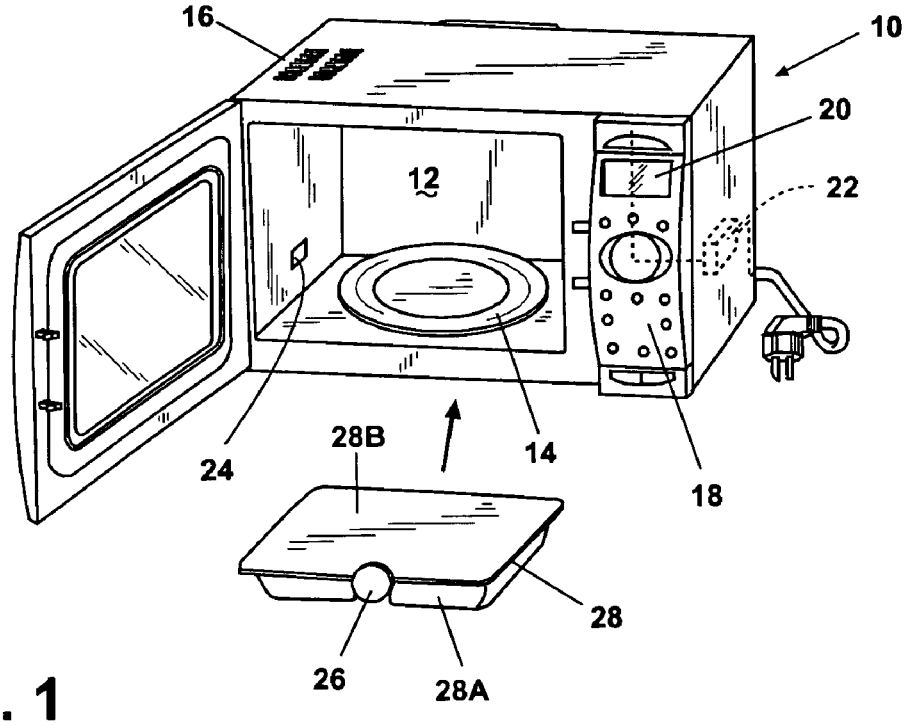
FIG. 1 is a perspective view of a microwave oven embodying the principles of the present invention.

With reference to FIG. 1, a microwave oven 10 of the present invention is shown having a oven cavity 12 with a rotating plate or turntable 14 and an exterior cabinet 16. A user interface 18 and display unit 20 is provided along a front surface and is connected to a control unit 22 of the oven. An optical detector 24 is provided which is able to detect the color change of a thermochromic element or disc 26 mounted onto a food package 28. The food package 28 may be of any type including the type comprising a tray **28*a* which may form a plurality of compartments for holding food item and a flexible film or cover 28*b*** for covering the food items.

Figure 2:
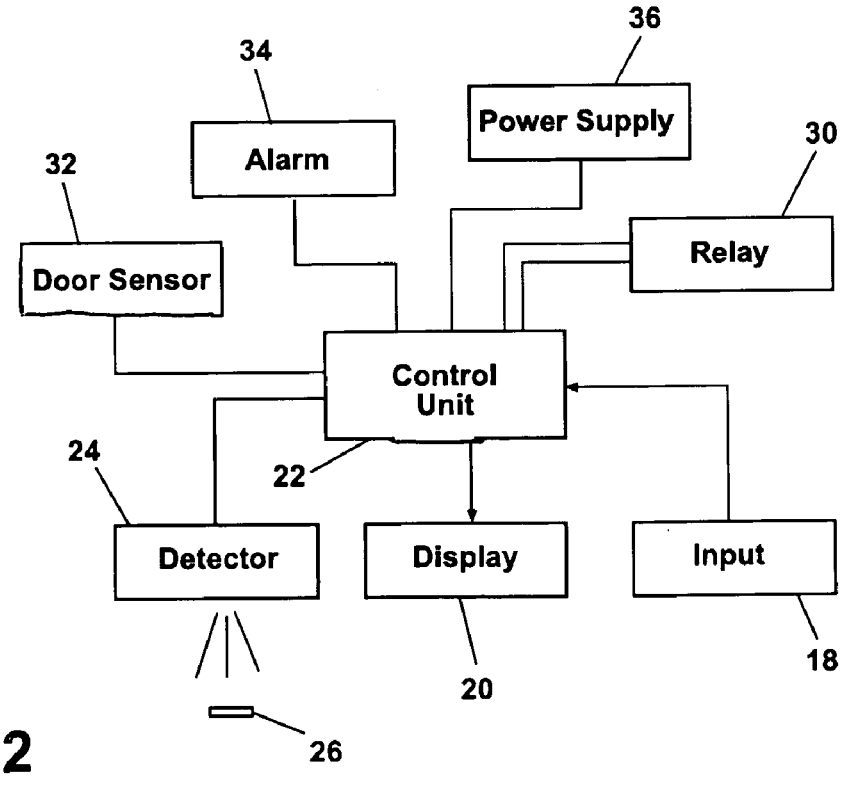
FIG. 2 is a schematic illustration of the control unit and control elements of the present invention.

FIG. 2 illustrates the control system for the present invention. This system comprises the control unit or microprocessor 22 for storing key data inputted from the user interface input device 18 and for controlling the operation of the whole system of the microwave oven. The control unit 22 operates to control relay drive unit 30 for controlling a high voltage transformer (which oscillates a magnetron) and the turntable motor. A door sensing unit 32 is provided for sensing the opening and closing of the door of the microwave oven. The display unit 20 receives signals to display the status and the time, etc, of the microwave oven. An alarm generation unit 34 operate a buzzer or other device for alarming the termination of cooking. A power supply unit 36 is provided for supplying the power to each unit of the system. The detector unit 24 senses the presence and color change of the reflective disc 26 as described further herein.

During use, the food package 28 with the thermochromic disc 26 is placed in the oven cavity 12 for heating. As the disc is heated, due to its thermochromic properties, it will change color. The dielectric properties of the disc material are tailored to give a specific power dissipation when the disc is subject to microwaves. The thermochromic element 26 may be mounted to a small block or plate of a polymeric material which is thermally insulated from the food stuff, and which is arranged to be subject to the same microwave radiation as the food stuff inside the oven, and which, through the choice of suitable dielectric properties, is subject to heating corresponding to that of the food stuff, such as disclosed in Swedish patent SE 0302030. The thermochromic element 26 may be connected or associated with food packaging 28 in many different ways and may be formed as part of a packaging label for the food package 28.

The detector 24 may be of any type but is preferably, an opto-electronic device, capable to detect the color change of the disc. The detector unit 24 may consist of a high intensity LED and a light detector tuned to the same light wavelength. There may also be a filter in front of the detector tuned to the LED wavelength. The light source and the light detector can be mounted together as a unit. The detector 24 may be positioned perpendicular to a radius of the turntable 14 and at a horizontal angle looking towards the centre of the turntable 14. The detector operates a light source (e.g. LED) to emit a beam of light and receive the reflected signal. In order to overcome the problem of interfering light sources, the light source may be pulsed and a synchronous rectifier may be used to discriminate between the measuring signal and interfering light sources.

Upon initiation of heating, the turntable 14 is rotated causing the package 28 and thermochromic disc 26 and food items to rotate as well. This rotation of food items is well know in a microwave oven and provides for even heating of food items. The rotation of the food and the disc 26 is an important aspect of the detection technology. When the disc 26 is not in front of the detector 24, a zero level for the signal can be established. When the thermochromic disc 26 passes the detector, a pulse will be detected. This helps in detecting abnormal conditions, such as a missing disc. This condition can then be communicated to the user through the display 20 or audible signal.

Figure 3:
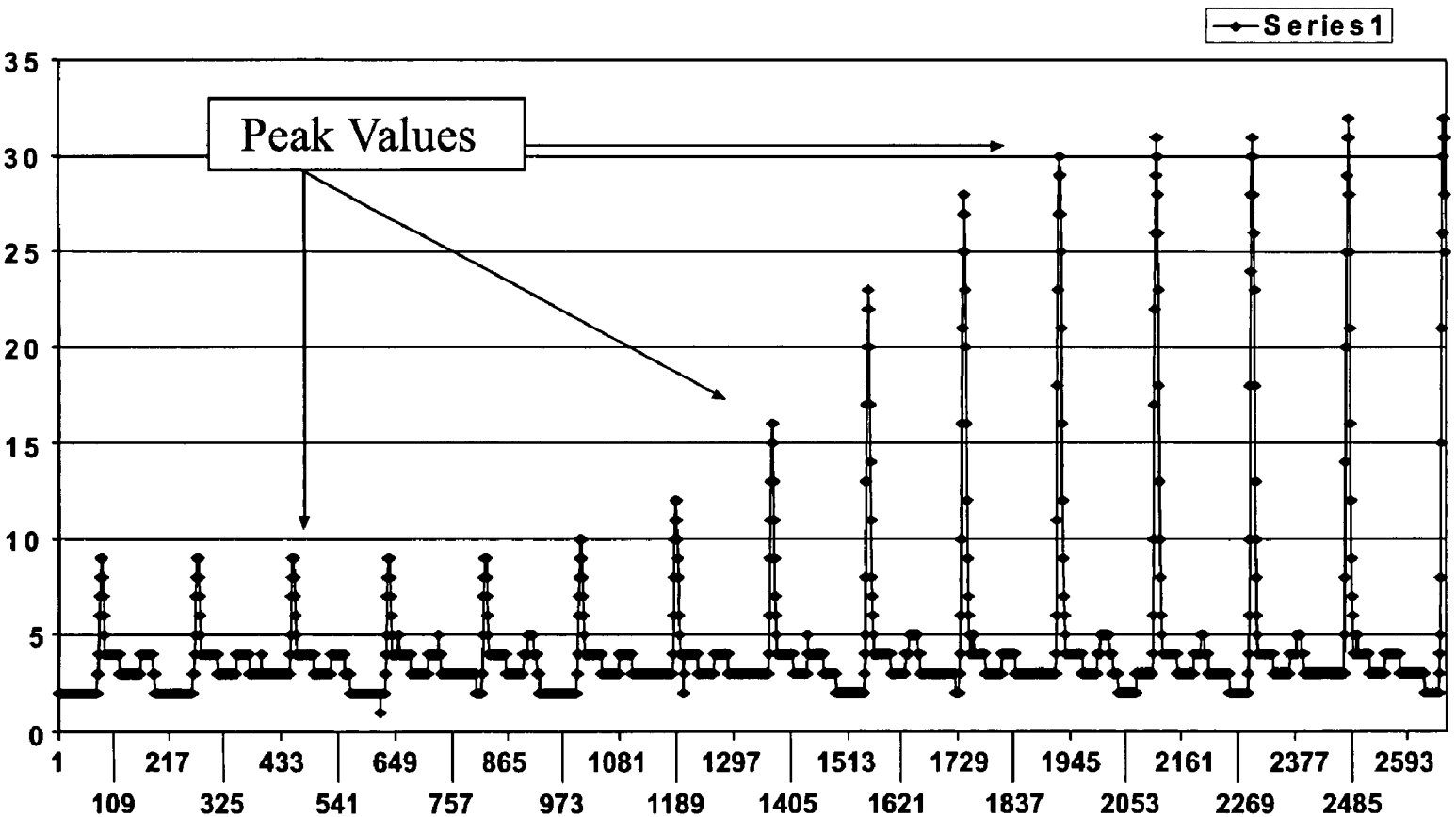
FIG. 3 is a graph showing the change in pulse signals received by the detector as the food package rotates within the oven.

The diagram shown in FIG. 3 shows the peak in reflection that is recorded by the detector 24 for each turn as the disc 26 passes. By comparing each peak with the two proceeding peaks, it is possible to determine when the change in color has taken place. Additionally, the absence of signal peaks can be used to identify a misalignment of the disc 26 or system failure.

Figure 4:
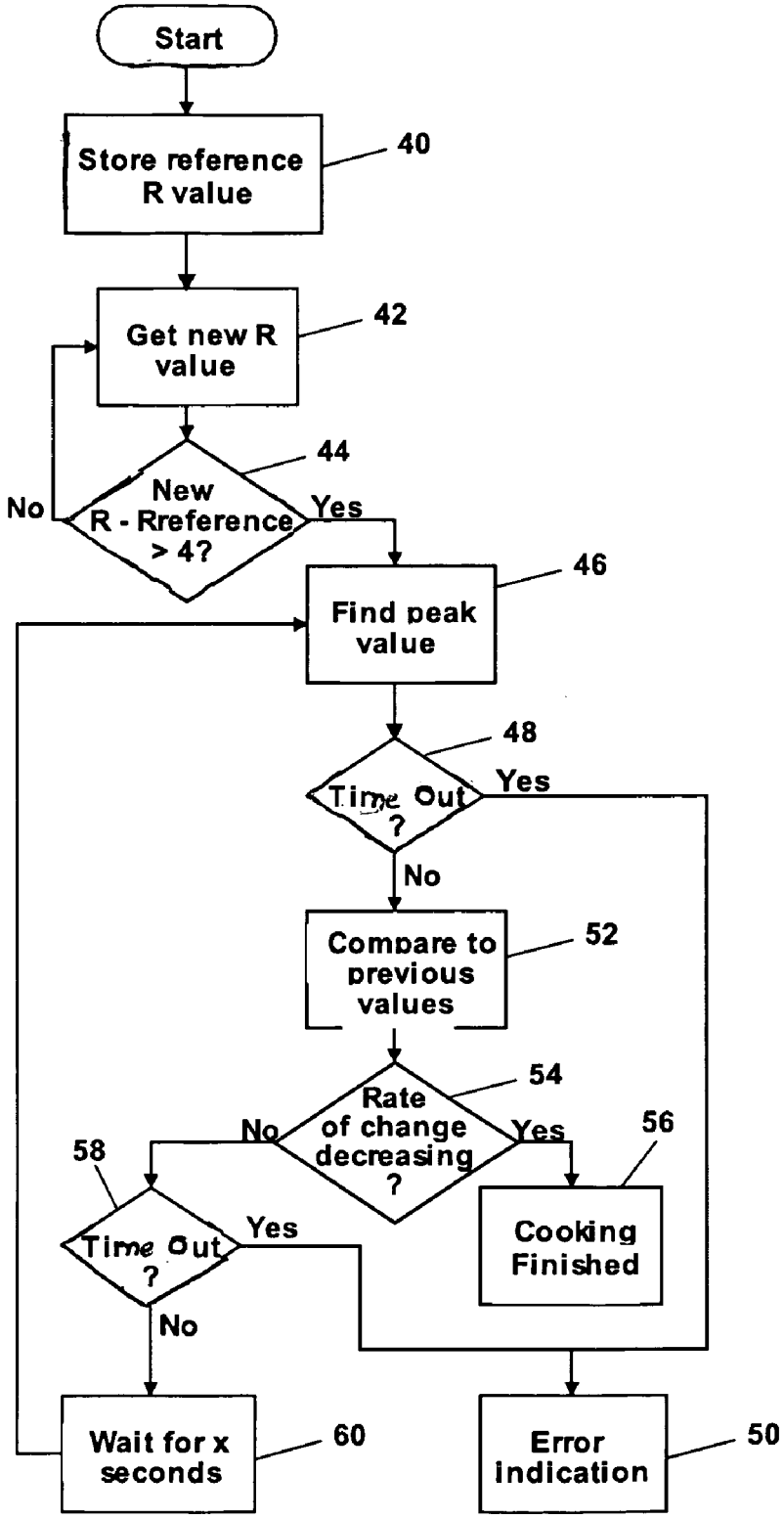
FIG. 4 is a flow chart illustrating the operation and control of the microwave oven of the present invention.

FIG. 4 illustrates the control logic utilized in the present invention. Upon initiation of a heating cycle, the system operates to store a reference reflection R value and sense new reflection R values, steps 40, 42 and 44. After a predetermined period, the system begins to sense for peak values, step 46. If no peak is sensed for a pre-set period of time the current program will terminate and an error indication and/or audible signal will be displayed to the user, steps 48 and 50. During this time, microwaves will be applied to the food load and therefore, in a timeout condition, the food will be exposed to some amount of microwave energy.

When peak values are successfully measured, these values are compared to previous values and the rate of peak value change is measured, steps 52 and 54. When the rate of change decreases to a predetermined level approaching zero, this indicates that the color change has been accomplished. By correlating this to the proper temperature of the food item, this condition can be used to identify when the food has reached the desired temperature and cooking can be terminated, step 56. In the event peak values do not decrease over a pre-set time, the system indicates to the user an error indication, steps 58 and 50.

The present system provides a method of using the thermochromic disc 26. Varying alignment of the disc 26 with the detector 24 leads to a varying level of reflection. A system seeking an absolute or predetermined reflection value is susceptible to failure due to misalignment. In the present invention, it is variation or rate of change in the reflection signal due to rotation of the turntable that is monitored to determine the proper end cooking period. It can be understood that any color change can be used.

Apparent from the foregoing specification, the invention is susceptible of being embodied with various alterations and modifications which may differ from those that have been described in the specification and description. It should be understood that we wish to embody within the scope of the patent warranted hereon all such modifications within the scope of our contribution to the art.

The invention claimed is:

1. A method of operating a microwave oven to determine the correct cooking time for a food item placed within the oven, the method comprising the steps of:

placing in the microwave oven a food package having a thermochromic element which changes color over a predetermined temperature range;

supplying microwave energy into the oven;

rotating the food package within the oven cavity;

monitoring the color of the thermochromic element as it rotates past a detector for detecting the color changes of the thermochromic element such that a plurality of signal pulses are generated having a value corresponding to the color of the element;

terminating the supply of microwave energy into the oven when the rate of change between successive pulses decreases to a predetermined value.

2. The method of operating a microwave oven according to claim 1, wherein the supply of microwave energy into the oven is terminated and an error signal is provided to the user if no signal pulses are measured within a predetermined time period.

3. The method of operating a microwave oven according to claim 2, wherein the error signal is communicated to the user through a display unit and/or audible signal.

4. The method of operating a microwave oven according to claim 2, wherein the error signal indicates that the food package within the oven is adjustable for optimal signal measurement.

5. The method of operating a microwave oven according to claim 1, wherein if the rate of change between successive signal pulses does not decrease within a predetermined time period, the supply of microwave energy into the oven is terminated and an error signal is provided to the user.

6. The method of operating a microwave oven according to claim 1, wherein the value of the signal pulses increase during the heating of the thermochromic element and wherein the supply of microwave energy into the oven is terminated when the rate of change between successive pulses decrease to a predetermined value.

7. The method of operating a microwave oven according to claim 1, wherein the thermochromic element is mounted to a small block or plate of a polymeric material which is thermally insulated from the food item and which is subject to heating corresponding to that of the food item located provided within the food package.

8. The method of operating a microwave oven according to claim 1, wherein the thermochromic element is applied and forms part of a food package label.

9. The method of operating a microwave oven according to claim 1, wherein the detector is an opto-electronic device capable of emitting and receiving a light signal.

10. The method of operating a microwave oven according to claim 9, wherein the emitted light signal is pulsed such that a reflected light signal can be discriminated from a competing light source.

* * * * *